US006988636B1

(12) United States Patent
Loh

(10) Patent No.: US 6,988,636 B1
(45) Date of Patent: Jan. 24, 2006

(54) FOOD TRAY WITH DRAWER

(76) Inventor: Bill Loh, 441 Cola Ballena, Alameda, CA (US) 94501

( * ) Notice: Subject to any disclaimer, the term of this patent is extended or adjusted under 35 U.S.C. 154(b) by 0 days.

(21) Appl. No.: 10/427,288

(22) Filed: Apr. 30, 2003

Related U.S. Application Data

(63) Continuation-in-part of application No. 10/337,553, filed on Jan. 7, 2003, now abandoned, and a continuation-in-part of application No. 10/067,007, filed on Feb. 4, 2002, now abandoned.

(51) Int. Cl.
*A47K 10/24* (2006.01)

(52) U.S. Cl. ..... 221/45; 220/556

(58) Field of Classification Search ..... 221/33, 221/45, 46, 199; 220/521, 556, 507, 555; 206/319, 372, 273; 229/406, 904
See application file for complete search history.

(56) References Cited

U.S. PATENT DOCUMENTS 5,544,744 A * 8/1996 Oman ..... 206/319
6,129,232 A * 10/2000 Williams ..... 220/521

* cited by examiner

*Primary Examiner*—Kenneth Noland
(74) *Attorney, Agent, or Firm*—Robert Samuel Smith

(57) ABSTRACT

A carrier especially for fast food comprising a tray section secured to the top edge of a frame section. The frame is made preferably of heavy paper to facilitate printing of advertisement thereon. The tray section is a a thermoplastic panel with depressions for receiving food. In one embodiment, the frame has a floor panel arranged to support a drawer between the tray section and frame section. A front panel of the frame section has a slot that is constructed to permit withdrawing the drawer positioned from inside the container through the slot. The drawer is positioned on top of a napkin that has a corner extending through the slot and is withdrawable from the carrier when required. A suction cup with a hook integrally formed on the convex side is provided to attach the carrier to window of an automobile.

14 Claims, 11 Drawing Sheets

FIG 9

PROVIDE DISPENSER INCLUDING TRAY SECTION WITH DEPRESSIONS AND CONTAINER SECTION WITH SLOTS, AND NAPKIN

DEPOSIT FOOD ITEMS IN DEPRESSIONS

SUPPORT DISPENSER IN ONE HAND

WITHDRAW FINGER FOOD WITH OTHER HAND

WITHDRAW NAPKIN

Fig 12. A
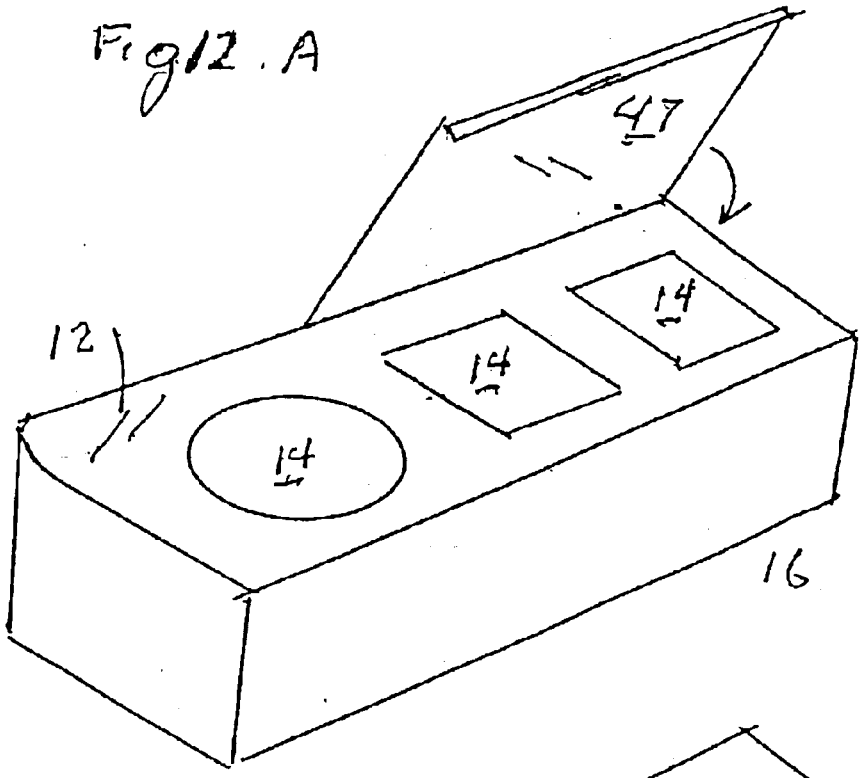
Fig 12 B
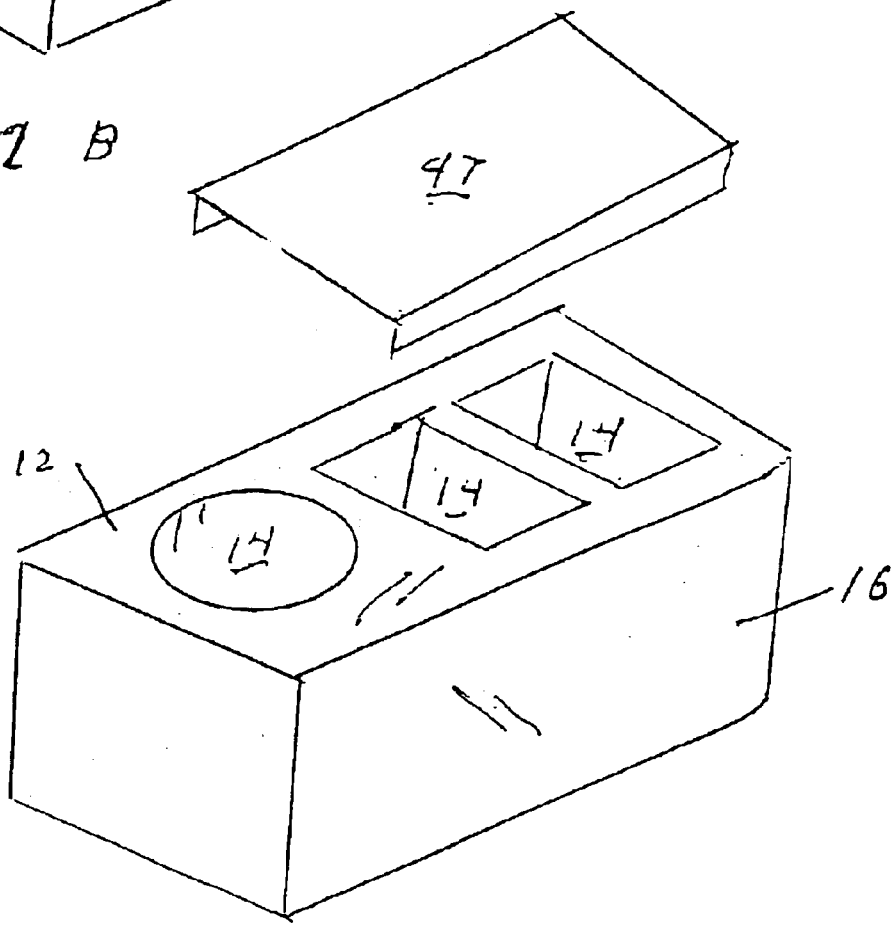

FIG. 14

ENGAGE HOOK WITH CARRIER

REST CARRIER ON SILL

ATTACH SUCTON CUP TO WINDOW

EAT MEAL (OPTIONAL, PULL DRAWER FOR ACCESS TO KETCHUP)

FOOD TRAY WITH DRAWER

CROSS REFERENCE TO RELATED APPLICATIONS

This application is a continuation in part of application Ser. No. 10/337,553 filed Jan. 7, 2003 and application Ser. No. 10/067,007 filed Feb. 4, 2002 now abandoned, from which priority is claimed.

FIELD OF THE INVENTION

This invention relates to trays such as used for carrying and dispensing fast food and particularly to a tray with a drawer.

BACKGROUND AND INFORMATION DISCLOSURE

Fast food is the term applied to food that members of the public purchase generally as "take out" food from any one of a number of chain stores which is often eaten, e.g., in cars when the customer is on a road trip, or at parties, picnics or sporting events where formal "sit down" facilities are not available. Popular fast food items include potato chips, French fried unions and potatoes, beef jerke, hamburgers, hot dogs, etc. The menu almost always includes a beverage, for example a soft drink, coffee, tea or milkshake.

Dispensing fast food has become a major industry. Chains of fast food stores have spread around the world. These chains are often operated as franchises wherein the corporate office supplies the franchisee with all kinds of tools and procedures for operating the franchise such as a standard menu.

As competition among the chains increases, each chain strives to include more and more variety and added attractions to the fare—novel and convenient ways to provide the beverage, inclusion of condiments (ketchup, mustard, chopped onions, relishes) etc.

An important part of a successful operation includes provision of a carrier of food, beverage and utensils. Such a carrier has important requirements. It must be convenient to carry and, preferably, enable the user to eat his food in situations where "sitting down at a dinner table" is not feasible. It must be so inexpensive that it is disposable.

The food trays that are presently available are generally limited in terms of the function that they perform. As the variety of items increases, the demand for convenience increases. The demand for convenience translates to demand for features of a food carrier that provide the user with additional items such as a napkin, condiments, and utensils, etc.

An important concern for the purveyor of fast food is "getting his message out to the publc"—advertising. If his advertising is sufficiently clever, (e.g., a humorous cartoon,) the public can be enticed to buy the product smply to obtain the advertisement. This is especially true of themes attractive to children such as Mickey Mouse, Harry Potter, etc.

Another desireable feature of packages for industry, is that the packages be "stackable". I.e., the empty packages (before use) should be storable as stacks of packages in order to reduce the requirement for storage space.

SUMMARY OF THE INVENTION

It is an object of this invention to provide a carrier for dispensing fast food items together with associated items such as utensils, condiments, etc. It is another object that the carrier be inexpensive, and therefore readily disposable.

It is another object that the invention carry a message to the public in terms of effective advertisement.

It is a further object to provide a carrier for food that a user can hold in one hand and, with the other hand, drink through a straw or eat food from the carrier or whatever else he wants to do with the other hand such as using a phone, shaking hands, etc.

In one embodiment, this invention is directed toward a carrier for food including a tray section fitted onto the open top of a frame (box) section that includes a front wall, a rear wall, two sidewalls. The tray section has a plurality of depressions. Each depression is shaped for depositing a food item therein, such as a hamburger, French fries, etc. One of the depressions is intended for holding a beverage, accessible with a drinking straw.

In a preferred embodiment, the tray section comprises a material, such as a thermoplastic, that resists deterioration due to absorbtion of moisture from food stored in the depressions. The frame section comprises a cellulosic material (paper, cardboard) that is inexpensive. The cellulosic frame section is also convenient in terms of economy for substituting various advertising themes according to the requirements of the purveyor simply by exchangng the frame without having to pay the expense of another tray section.

In another version, the floor section has a floor panel. The depth of the depression is selected to leave a space between the bottom of the depressions and the floor panel. A slot is formed in the front wall. The slot has a long dimension oriented parallel to the floor panel to permit positioning a napkin between the floor panel and the bottom of the depressions. The napkin is withdrawn through the slot when required.

In another embodiment, a drawer is positioned on top of the napkin under the depressions. The drawer is withdrawable through the slot. The drawer is intended for storing condiments and utensils.

The drawer and its contents are isolated from food that is stored in the depressions in the tray so that juices from the food do not drip down onto the contents of the drawer nor the napkin under the drawer.

Another important advantage of the frame section that is made of paper is that the frame (with or without the floor panel) can be folded (flattened) and stored in a stack of folded frames.

The tray sections can also be stacked separate from the frames.

Another version of the invention is an important convenience to the "drive through" market, (restaurants) i.e., customers who prefer to sit in their cars while eating food. This presently constitutes about 60% of the fast food market. In this embodiment, a hook, integrally molded to a suction cup, is provided. The bottom of the carrier rests on the window sill of the car next to the passenger-eater. The suction cup is adhered to the window glass and the hook is engaged with the edge of the tray section.

The foregoing summary has highlighted features, aspects and advantages of the present invention. The invention is further explained by the following description of what I presently believe to be the best mode for carrying out the invention illustrated by drawings to which claims are appended which define the scope of the invention.

BRIEF DESCRIPTION OF THE FIGS.

Figure 4A:
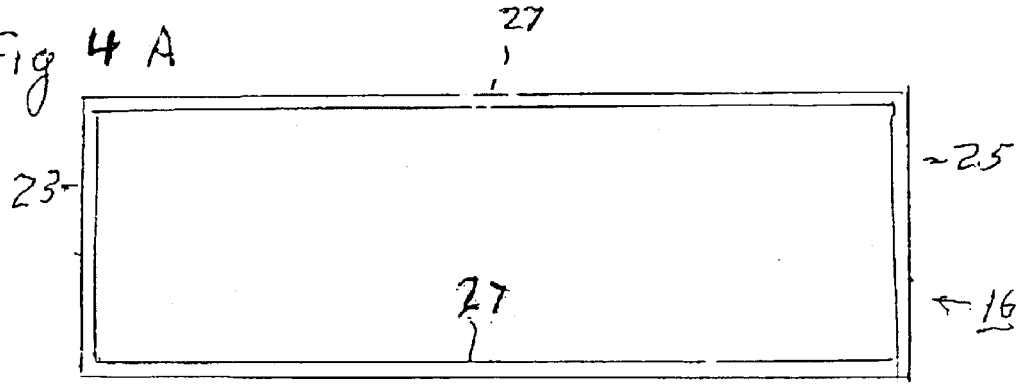
Figure 4B:
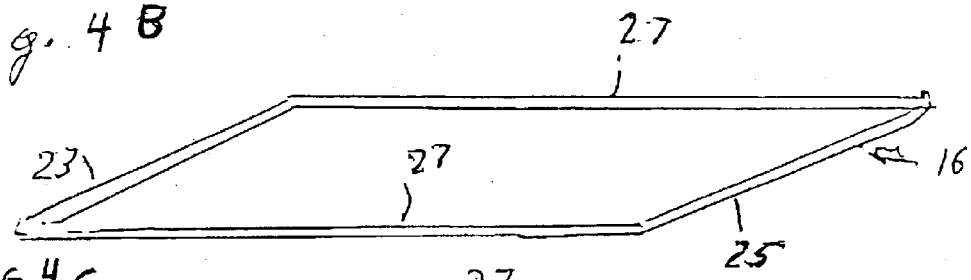
Figure 4C:
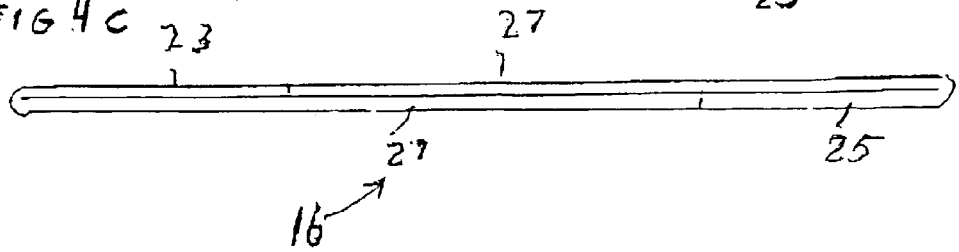

FIGS. 4A–C show views of the frame section in three stages of fold.

Figure 5:
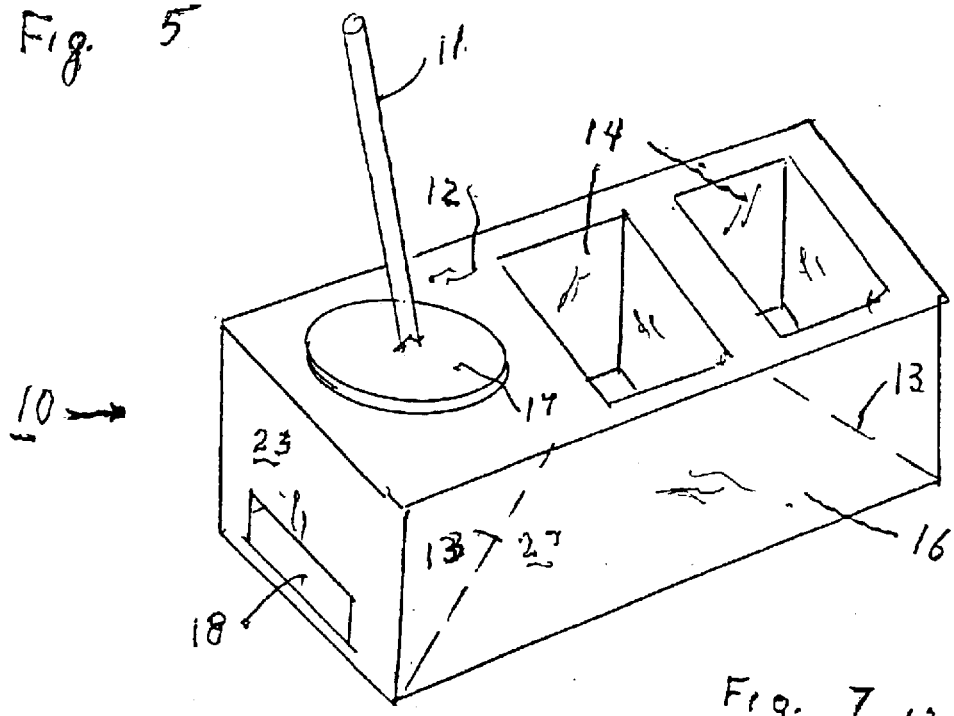

FIG. 5 is a perspective view of the invention showing a slot for inserting a napkin.

Figure 1:
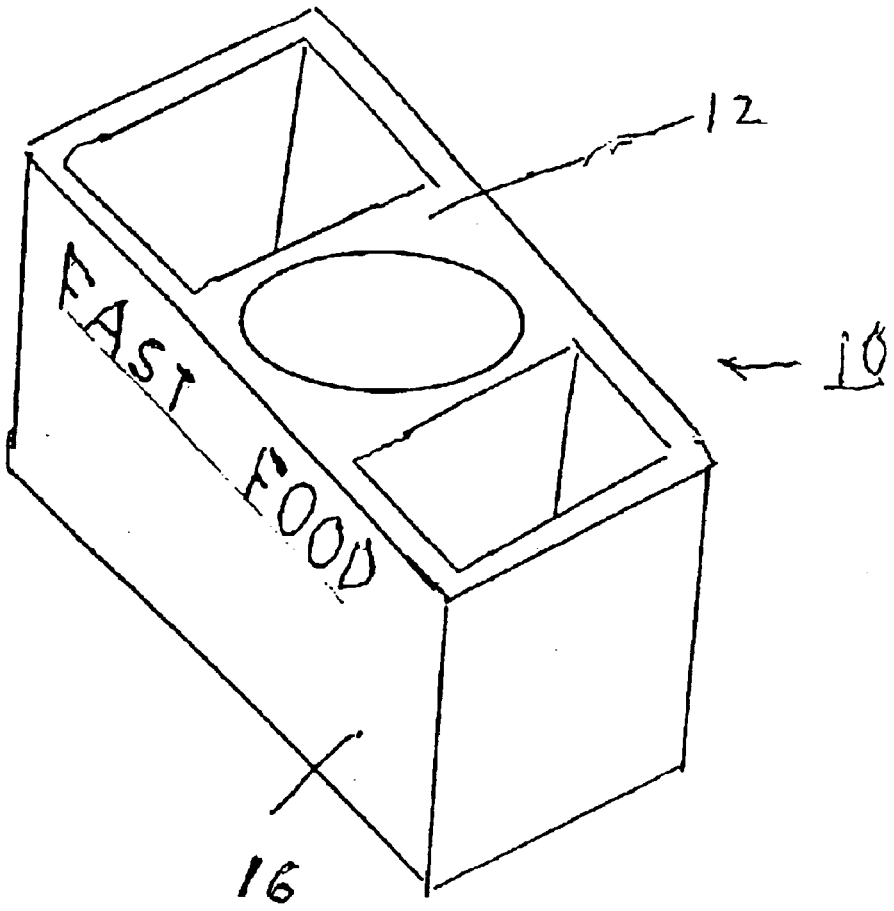
FIG. 1 shows one embodiment of the food carrier of this invention.
Figure 6:
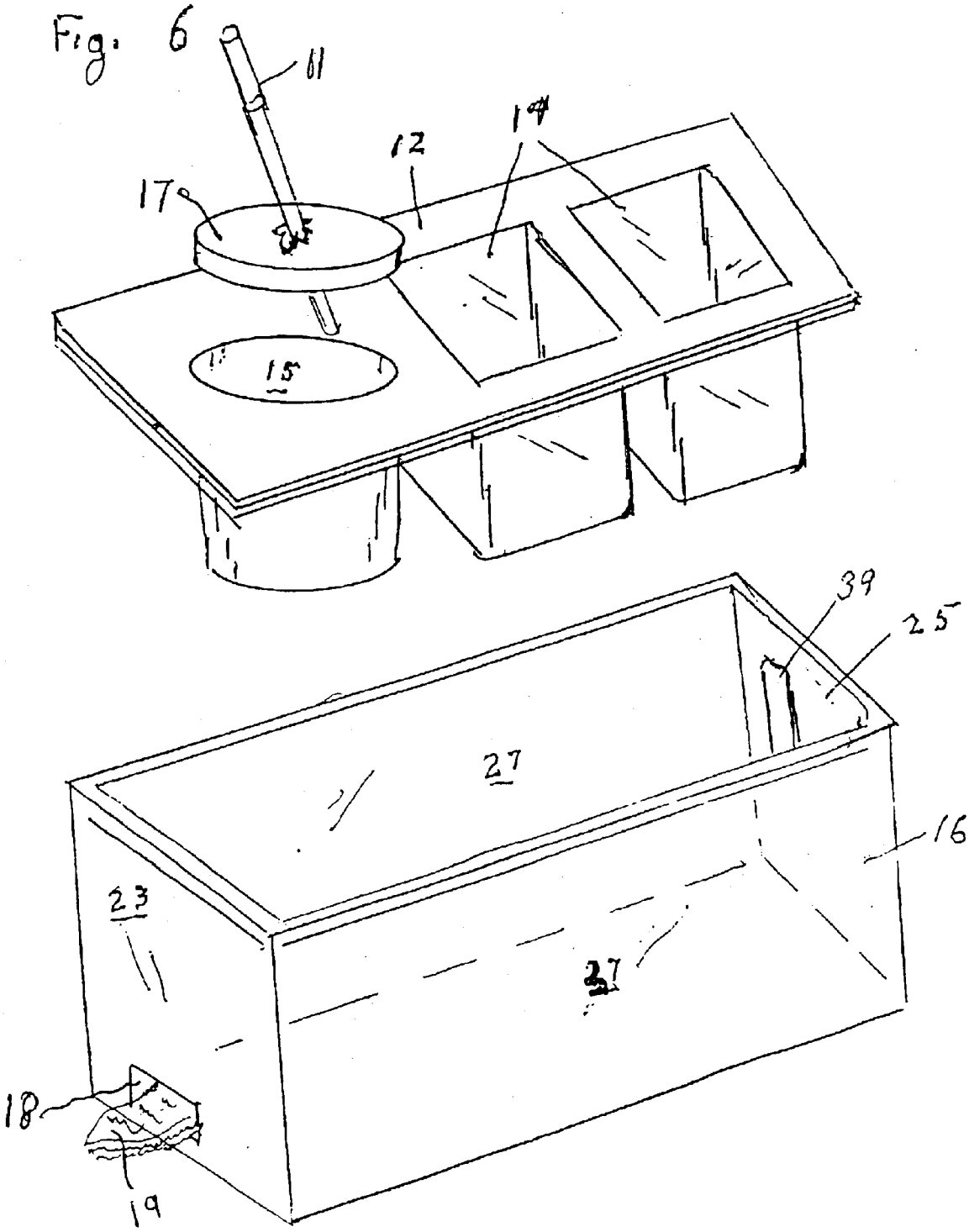

FIG. 6 is an exploded vew of FIG. 1.

Figure 7:
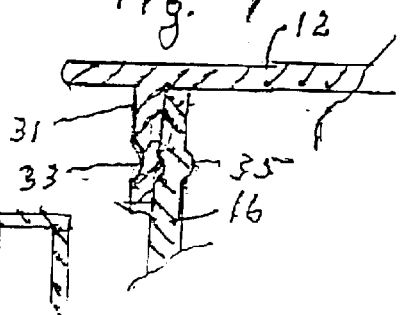

FIG. 7 is a cutaway sectional view showing the tray section joined to the frame section.

Figure 8:
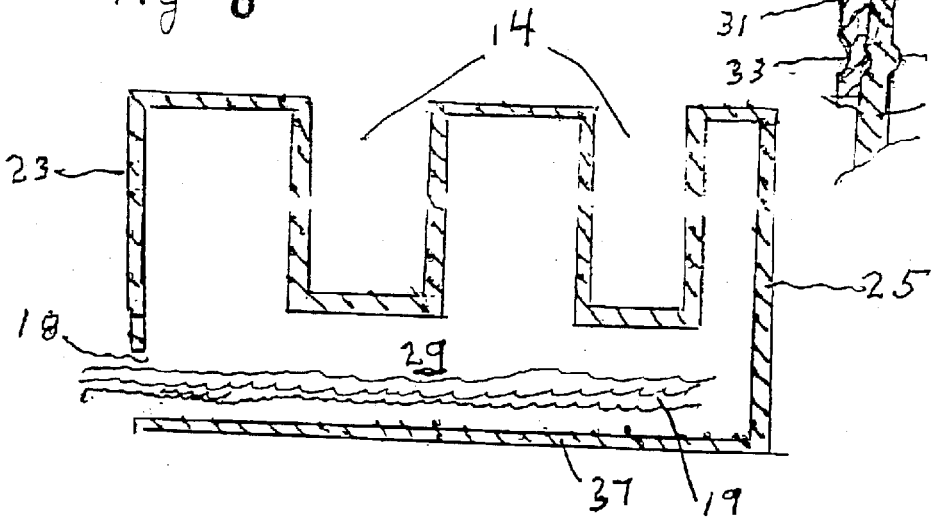

FIG. 8 is a sectional view showing the slot for the napkin positioned in the space between the bottom of the depressions and the floor of the container.

FIG. 9 is a lst of steps in the method for practicing the invention.

Figure 10A:
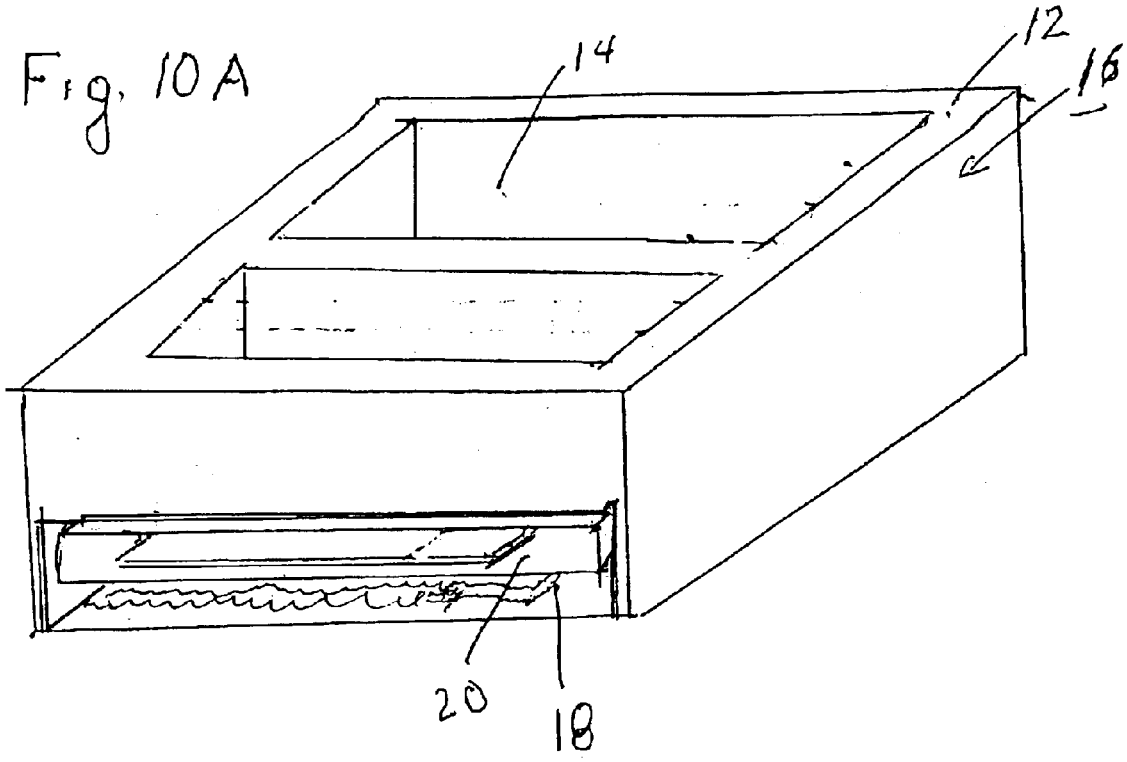

FIG. 10A is an assembly view of an embodiment of the carrier having a drawer.

FIG. 10R shows the drawer.

Figure 11:
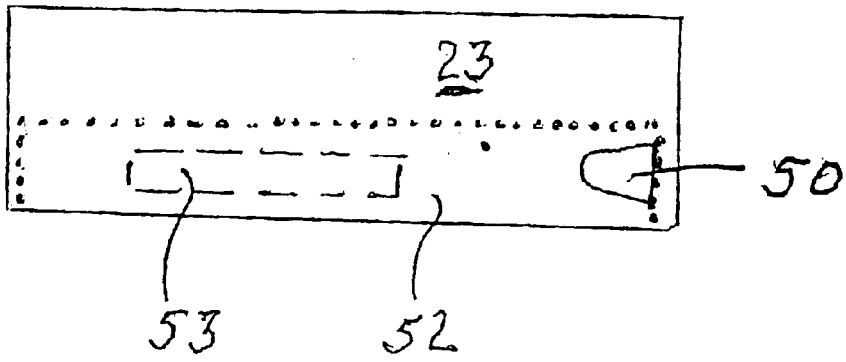

FIG. 11 shows a tearoff section of the front panel providing an opening to withdraw the drawer.

FIGS. 12A,B are perspective views of a lid hingeably attached to the tray section.

Figures 13A, 13B:
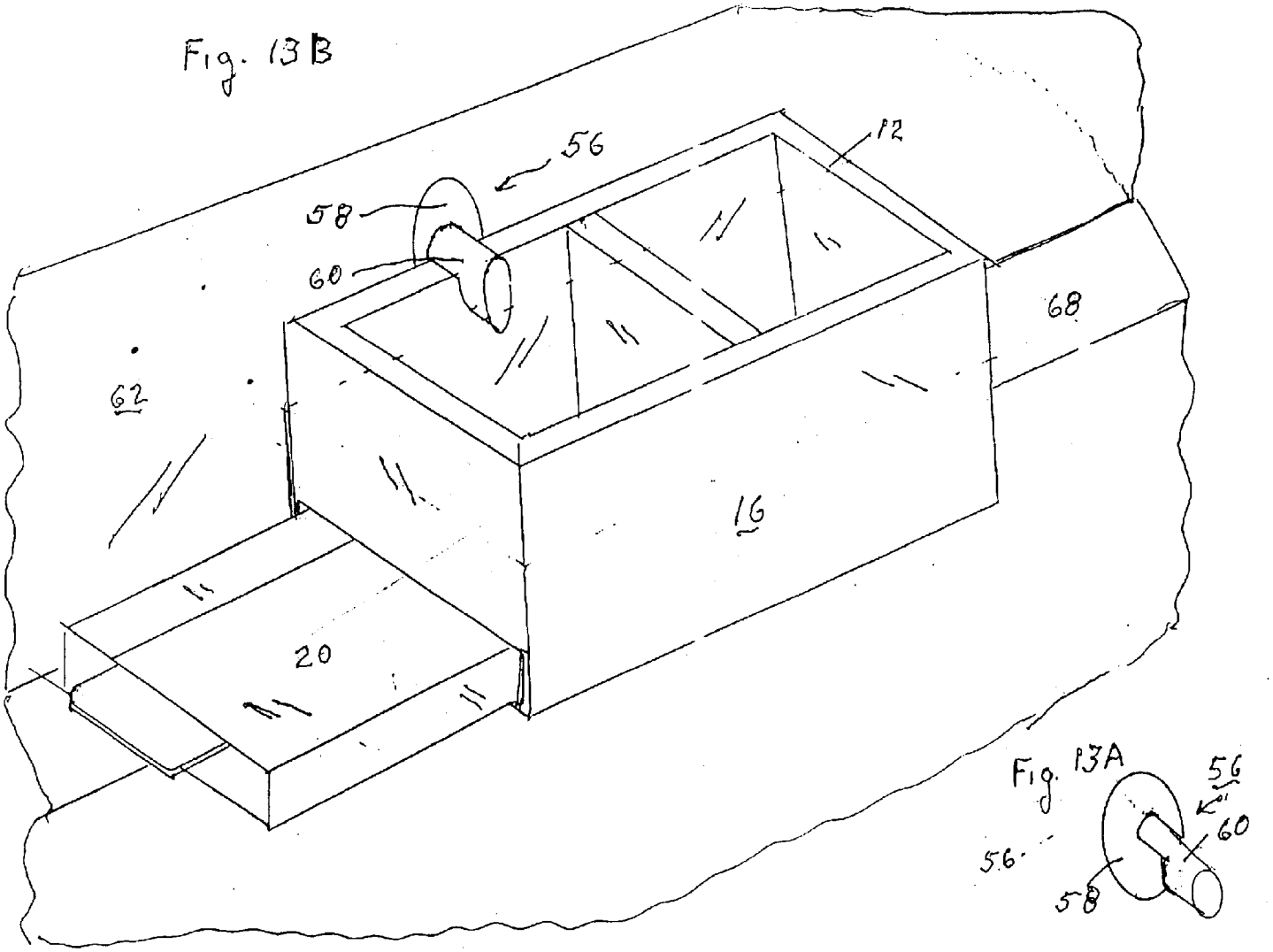

FIGS. 13A,B show a hook molded to a suction cup for attaching a tray to the window of an automoble.

FIG. 14 is a flow chart of the method for using the suction cup-hook of FIGS. 13A,B.

DESCRIPTION OF A BEST MODE

Figure 2:
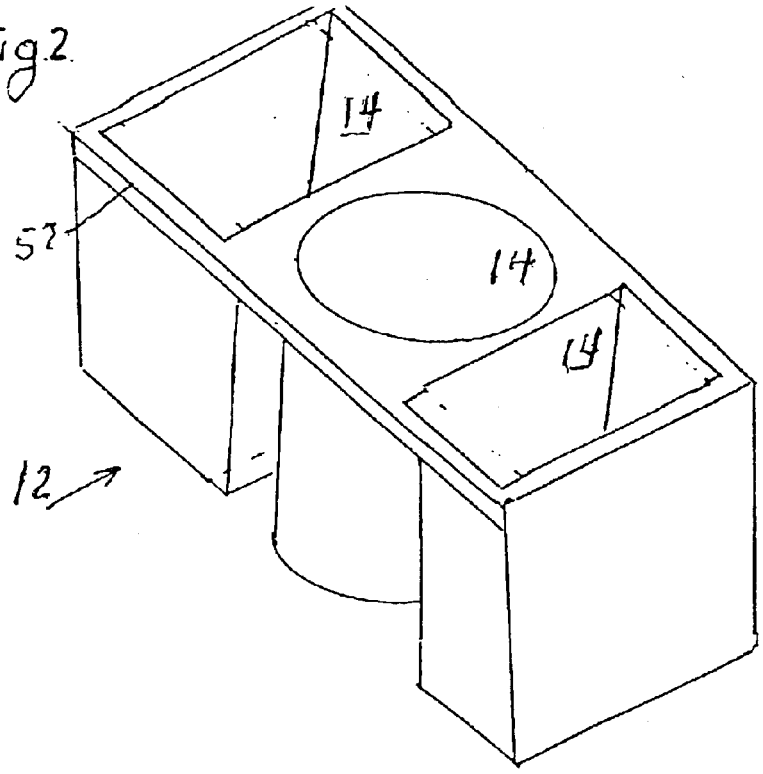
FIG. 2 shows the tray section poised for attachment to the frame section.
Figure 2:
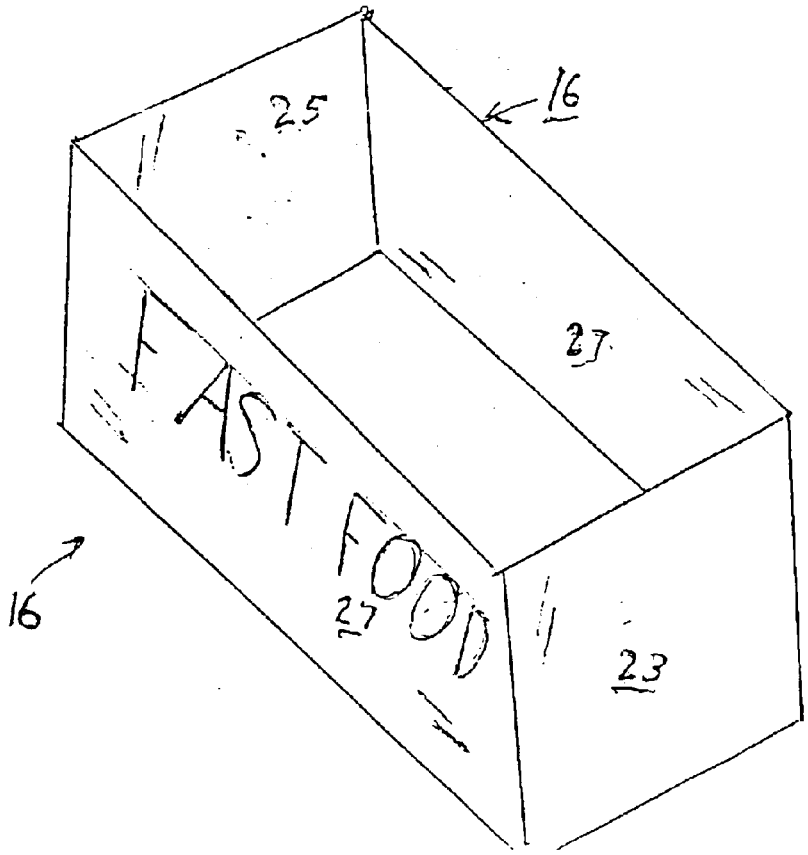

Turning now to a discussion of the drawings, FIG. 1 is a perspective assembly view of the invention 10 comprising a tray section 12 and a frame section 16. In FIG. 2, the tray section 12 is poised for posititioning on the frame section 16 so that the rim of the tray section 12 engages the rim of the frame section 16.

Figure 3:
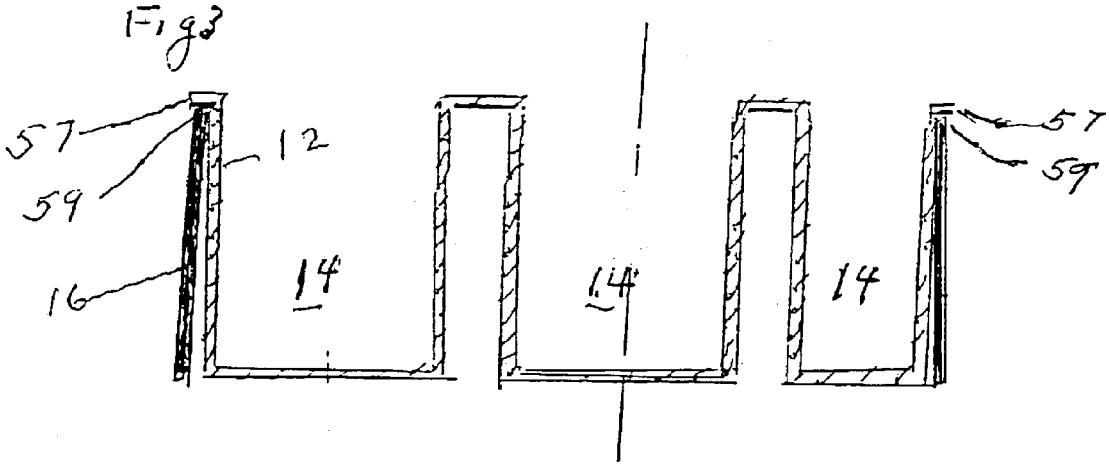
FIG. 3 is a sectional view showing the tray section joined to the container section.

As shown in the sectional view of FIG. 3, the tray section 12 is a panel with a plurality of depressons 14. Engagement of the rim of the tray secton 12 with the rim of the frame section 16 is shown.

Depressions 14 in the tray section are shaped and dimensioned for holding beverages and solid food such as French fries, kebobs, etc.

FIG. 2 shows the frame section 16 comprising a front panel 23, a rear panel 25 and two adjoining side panels 27.

The design of the carrier as comprising two separate entities (the tray section 12 and the frame section 16) has important advantages.

One advantage is that the material selected for the tray section 12 is guided by the requirement that the tray section be capable of resisting deterioration due to absorbtion of moisture from food deposited in the depressions. It is also desired that the tray section be capable of "standng alone" (unsupported).

Accordingly, the tray section 12 comprises preferably a thermoplastic. The tray section can be formed by vacuum forming.

The frame section comprises a cellulosic material such as heavy paper, cardboard or corrugated cardboard. An important advantage of paper or cardboard is the ability to print decorations or alpha-numeric indicia on the outside surfaces. This capability provides a very powerful advertising medium. The broad surfaces of the fire can be used to diplay features such as cartoons, endorsements, etc. that would be especially attractive to young users. A number of groups of frames can be made where, in each group, an attractive design is presented to attract a specific market.

Another advantage of fabrcating the frame section from paper is that the paper frame is "foldable". As illustrated in FIGS. 4A–C the design of the frame permiits collapsing (folding) the frame so that large numbers of frames can be stored and shipped as a stack of frames.

FIG. 4A shows a top view of the frame 16 completely open.

FIG. 4B is a top view of the frame section 16 with the frame section 18 partially collapsed.

FIG. 4C is a top view of frame section 16 with the frame section completely collapsed.

FIG. 5 is an assembly view and FIG. 8 is a sectional view of the invention in which the frame section 16 has a floor panel 37 with edges connected to front panel 23, rear panel 25 and side panels 27.

Fold lines 13 are shown along which the frame section 16 is folded when required to store stacks of flattened frame sections 16.

FIG. 6 is an exploded view of FIG. 5 showing a tray section 12. Tray section 12 is a panel 12 having depressions 14 for storing food.

Optionally, one depression 15 is configured for containing a soft drink. This depression is provided with a lid 17 having a drinking straw 11 for drinking a beverage stored in the depression 15.

FIG. 7 is a sectional cutaway view showing the edge of the tray section 12 configured to engage the edge of the rim of the container section 16. The tray section 12 has a skirt 31 with a bead 33 that engages a groove 35 near the edge of container section 16.

FIGS. 5, 6 and 8 show a slot 18 in the front panel 23.

FIG. 8 is a sectional view showing that a space 29 is provided between the floor panel 37 of the frame section 16 and the bottom of the depressions 14. The slot 18 has its longest dimension oriented parallel to the floor panel 37 and is dimensioned to permit withdrawing a folded napkin 19 through the slot 18 from the space 29 between the bottom of the depressions 14 and the floor panel 37 of the container 16.

An important feature of the invention is the method of manufacturing the carrier that includes positioning the napkin on the floor panel of the frame section with a corner of napkin 19 extending through the slot before the tray section 12 is mounted on the container section. This is a much more convenient situation than trying to insert the napkin into the space after the tray panel is secured to the frame section 16.

FIG. 9 is a list of steps for using the carrier according to the method of this invention.

In step 1, a dispenser is provided which comprises:

a container section having a front panel, rear panel and two side panels forming a frame having a rim joined to a floor panel;

a tray section being a panel with an edge that engages a top edge of the frame;

at least one depression in the tray section having a depth to provide a space between a bottom of said at least one depression and the floor of the container section;

a napkin deposited in the space, the napkin deposited in the space before the tray section is mounted on the container section;

a slot in the front panel having a long dimension parallel and proximal to the floor panel with a corner of the napkin extending through the slot thereby enabling a user to grasp the extended corner and withdraw the napkin from the container through the slot;

In step 2, at least one item of finger food is deposited in at least one of the depressions; In step 3, the user applies another one of his hands to withdrawing finger food from a respective depression and eating the withdrawn food; In step 4, the user withdraws the napkin through the slot and applies the napkin to cleaning a face of the user;

FIG. 10A shows another version of the invention that includes a drawer 20 positioned on top of the napkin 19.

The drawer 20 is shown inside the carrier section 16 in FIG. 10A and is withdrawable through the slot 18; Details of the drawer are shown in fig, 10B. A tab 54 is shown attached to the front panel of the drawer which a user grasps to withdraw the drawer through the slot 18.

FIG. 8 is a sectional view of the invention along line of sight 8—8 shown in FIG. 6;

FIG. 11 is a view of the front panel showing another version in which the tray is concealed behind the front panel 23. The front panel 23 has an opening 50 arranged to enable a user to slip his finger through the hole 50 and tear off a section 52 of the front panel. This leaves an opening dimensioned to permit grasping the tab 54 (see FIG. 10B on the drawer and pulling the drawer 20 through the slot 18.

FIG. 11 also shows, in phantom, a paper envelope 53 holding a toothpick adhered to the backside of secton 52 of the front panel 23. The toothpick is conveniently available to the user for use when he finishes his meal.

Figure 10B:
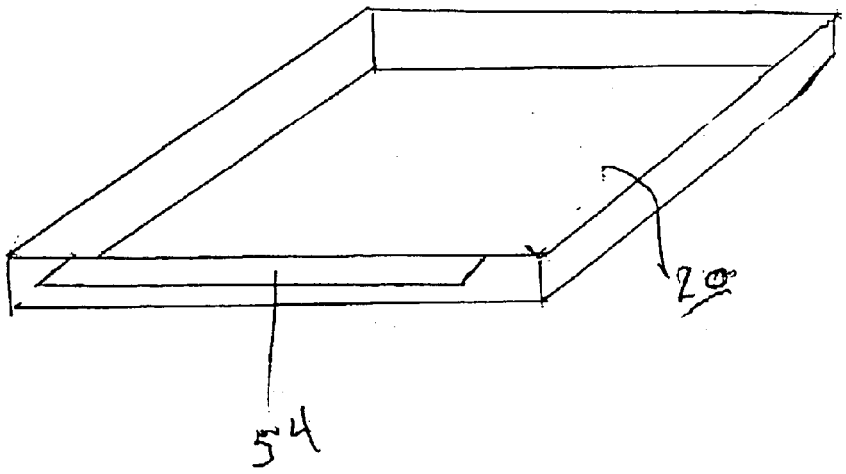

FIGS. 12A, B show embodiments in which the depressions 14 in the tray section 12 are covered by a cover 47. In FIG. 10A the cover is hinged to the tray section 12. In FIG. 10B, the lid is completely detachable from the tray section.

FIGS. 13A, B are views of a version of the invention being an accommodation for a user eating from the fast food tray of this invention while sitting in his car. FIG. 13A, shows a a tray holder 56 including a suction cup 58 integrally molded to a hook section 60. FIG. 13B shows the holder 50 in use wherein the suction cup 58 is adhered to the glass 62 of an automobile window (cutaway). The hook 60 is engaged with a an edge 64 of the tray section 66. The bottom of the carrer 10 is supported on the sill 68 of the automobile window.

In step 1, the user positions the carrier with the hook engaging an edge of the tray secton 12 and the bottom of the carrier supported partially on the sill of the window. In step 2, the user attaches the suction cup to a convenient location on the car window such that the hook extends away from the window. In step 3, the user cats the food from the tray.

The frame section 16 is preferably made of light cardboard or thin plastic. In the context of this specificaton, the term, paper, will be construed to mean cellulose materal; such as paper or cardboard or a medum particlularly adaptable to priintng advertsements thereon and folding when required for storage purposes.

According to a preferred method for manufacturing the carrier for distribution to the franchisee, the napkin is placed on the floor panel with a small corner of the napkin protruding out of the slot. The flaps are folded into position and the drawer is positioned in the container section 16 on top of the napkin before the tray section 12 is secured on top of the container section 16. This is an operation very conveniently performed in the manufacturing environment and provides a great convenience to the franchisee.

The carrier of this invention is very convenient to the user who is required to stand, holding the carrier in one hand, leaving the other hand free to eat his food (from the depressions) or shake hands with guests, etc. as required. The drawer provides useful space to the user for temporarily storing his utensils or condiments where they are isolated from drippage from food items stored in the depression. The drawer is fabricated of a plastic which permits pouring ketchsup directly into the drawer so that the user can dip his French fries into the open drawer. The napkin placed under the drawer is convenient to withdraw by grasping and pulling a small corner of the napkin extending out of the slot.

Variations and modifications of this invention may be contemplated by the reader after reading the specification and studying the drawings which are within the scope of the invention.

In view of these modifications and variations, I therefore wish to define the scope of my invention by the appended claims.

What is claimed is:

1. A carrier for partaking finger food that comprises:

a frame section being a front panel, a rear panel and two side panels joined along edges to form said frame;

a tray section being a panel with an edge that engages a top edge of said frame;

said tray section having at least one depression in said tray section;

said at least one depression having a depth;

said frame having a height being a dimension extending from said top edge and defining an area of said rear panel, front panel and two side panels;

said tray section comprising a tray material selected to hold food and resist deterioration from exposure to moisture from said food deposited in said at least one depression;

said frame section comprising frame material selected to permit folding said frame section into a storage configuration and to permit printing decorations and text on said area of said frame section;

at least one of decorations and text printed on said area.

2. The carrier of claim 1 wherein said tray material is a thermoplastic and said frame material is paper.

3. The carrier of claim 1 comprising:

a floor panel joined to a bottom edge of said frame;

said at least one depression in said tray section having a depth selected to provide a space between a bottom of said at least one depression and said floor panel;

a napkin positioned in said space;

a slot in said front panel having a pair of longest edges parallel to said floor panel and a pair of short edges perpendicular to said floor panel;

said slot is arranged to enable withdrawing said napkin from said space through said slot.

4. The carrier of claim 3 wherein said slot is configured to permit storing eating utensils with said napkin.

5. The carrier of claim 3 further comprising at least one lid, configured to fit onto a rim of said at least one depression.

6. The carrier of claim 5 wherein said at least one lid has a hole arranged for inserting a drinking straw through said hole into said depression.

7. The carrier of claim 3, comprising a drawer dimensioned to fit in said space and dimensioned for withdrawal from said space through said slot.

8. The carrier of claim 7 wherein:

a tab is fastened to said drawer, and said slot is defined by a score line outlining a section of said front panel;

said front panel has a finger hole;

said score line, finger hole and tab arranged to permit a user to insert a finger through said hole, tear said section from said front panel, grasp said tab and pull said drawer through said slot.

9. The carrier of claim 8 further comprising a toothpick on a packet adhered to an inside surface of said section providng that said packet is accessible to a user after tearing off said section from said front panel.

10. The carrier of claim 1 wherein said frame comprises heavy paper.

11. The carrier of claim 1 wherein said tray section is made of a thermoplastic.

12. The carrier of claim 1 which further comprises one of:

A) a cover for covering at least one of said depressions and arranged to detachably engage one edge and an opposite edge of said tray section;

B) a cover for covering at least one of said depressions having one edge hingeably attached to one edge of said tray section and an opposite edge arranged to detachably engage an opposite edge of said tray section.

13. The carrier of claim 1 further includes:

a suction cup;

a hook integrally formed on a convex side of said suction cup;

said suction cup operably arranged in combination with said hook for attachment to a glass of an automobile window while said hook is engaged with a depression in said tray section of said carrier and with a bottom of said carrier supported on a sill of the automobile window.

14. A method for eating food while sitting in an automobile that comprises the steps:

attaching the cup of claim 12 to a car window adjacent a seated user such that said hook extends away from said window;

engaging said hook with a depression in said tray section and the bottom of the carrier supported partially on the sill of said window;

eating food from said tray.

* * * * *